United States Patent [19]

Sheffield

[11] Patent Number: 5,056,697

[45] Date of Patent: Oct. 15, 1991

[54] GOLF TEE HOLDER

[76] Inventor: George E. Sheffield, 10215 SW. 53rd St., Cooper City, Fla. 33328

[21] Appl. No.: 528,166

[22] Filed: May 21, 1990

[51] Int. Cl.[5] ..... A63B 57/00

[52] U.S. Cl. ..... 224/253; 224/918; 273/320

[58] Field of Search ..... 224/918, 919, 253, 274; 206/315.1; 273/32 D

[56] References Cited

U.S. PATENT DOCUMENTS 1,789,910 1/1931 Rosenstein ..... 273/32 D
3,612,261 10/1971 Cicero ..... 224/918
3,870,300 3/1975 Amendola ..... 224/274
4,840,332 6/1989 Hoyt ..... 224/919

*Primary Examiner*—Renee S. Luebke
*Attorney, Agent, or Firm*—Malin, Haley, McHale, DiMaggio & Crosby

[57] ABSTRACT

A golf tee holder comprising an elongated receptacle slightly larger than the width of a tee that includes a longitudinal channel having one closed end, and a raised friction surface near the opening of the channel to prevent accidental removal of the tees from within the holder. The invention stores a plurality of tees in a very compact, easily accessible, lightweight durable holder.

14 Claims, 1 Drawing Sheet

FIG.1.
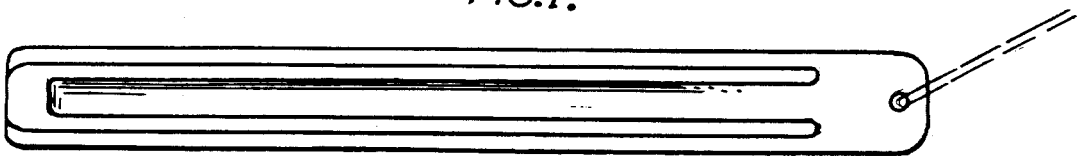
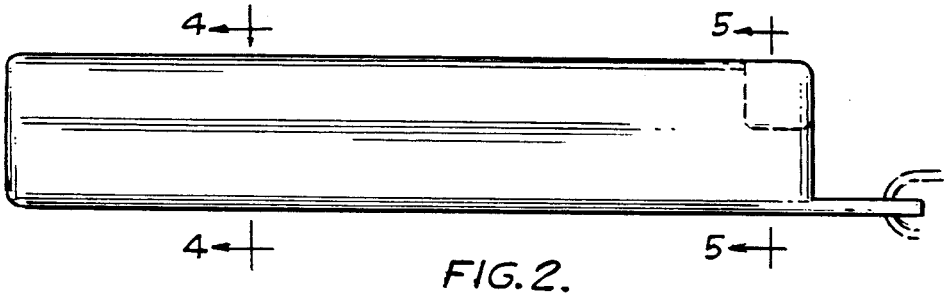
FIG.2.
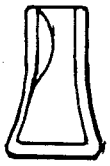
FIG.3.
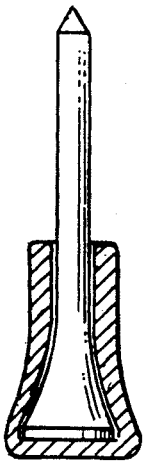
FIG.4.
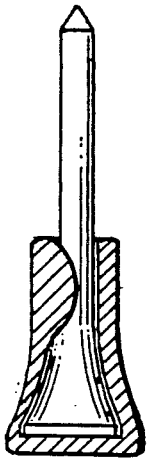
FIG.5.
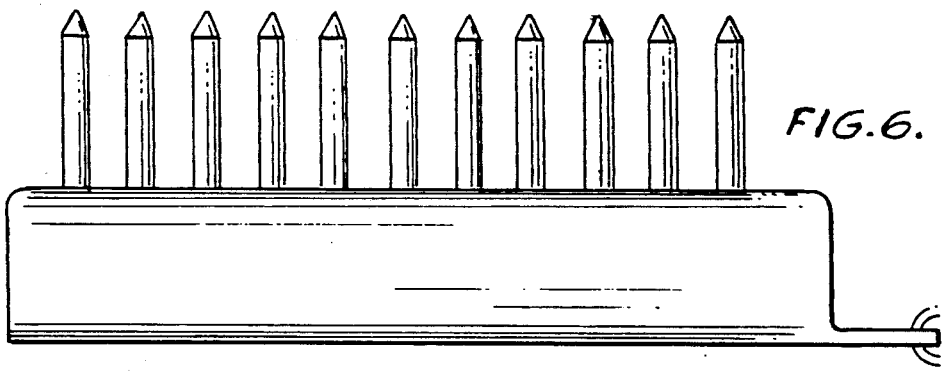
FIG.6.

GOLF TEE HOLDER

BACKGROUND OF THE INVENTION

1. Field of the Invention

This invention relates generally to golf tee holders and specifically .a golf tee holder having an improved housing that provides easy manual access for loading or dispensing a single tee and a substantial viewing area to visually inspect the condition of all the tees in the holder, while securely retaining all the tees regardless of movement or position of the device.

2. Description of the Prior Art

Golf tee holders have been shown in the prior art. Typically, the tees are individually loaded into a holder having individual holes, one for each tee. Such a device is shown in U.S. Pat. No. 4,850,483 which issued to Stack on Jul. 25, 1989 disclosing a plurality of tees individually mounted in a peripheral array, each extending out from the device. In this arrangement the tees can be easily dislodged and the array takes up extra space. Another type of golf tee dispenser is shown in U.S. Pat. No. 4,573,610 issued to Hurner, Mar. 4, 1986 in which the tees are serially loaded into a long cylindrical tube and then individually dispensed. Loading the tees requires disassembling the device and individually inserting the tees in a predetermined order. U.S. Design Patent 165,253 issued to Ward, Nov. 20, 1951, shows a golf tee holder that includes individual slots for each tee body along with grooved portions for resting the tee head. This device utilizes excessive space for the few tees that it holds. A golf accessory is shown in U.S. Pat. No. 4,784,305 issued to Schoenberg, Nov. 15, 1988, that includes golf ball holders and apertures along an elongated face of the device for holding tees. A very limited amount of tees can be held. Finally, a golf tee holder is shown in U.S. Pat. No. 1,739,780, issued to Buhke, Dec. 17, 1929, which provides a magazine-like holder in which the tees may be inserted parallel at one end and removed at the opposite end. Although this device holds a plurality of tees, it suffers from the drawbacks that the tees are not readily accessible for manually grasping for removal and are not readily visible for inspection by the user since the magazine covers both the head and end tip of the tee.

The present invention overcomes the problems of the prior art by providing a tee holder that can hold several tees mounted in a space efficient non-complex receptacle that allows for easy access for extracting a tee while ensuring that the tees are firmly held in place regardless of the position of the tee holder relative to the ground or when subjected to bumping or sharp movement. Also the tees are disposed in such a way as to be readily observable to the user for inspection.

SUMMARY OF THE INVENTION

A golf tee holder comprising a receptacle unitarily formed from a lightweight durable material such as plastic, said receptacle including an elongated back wall sized in width to be slightly larger than the diameter of the head of a tee, a pair of parallel walls connected to said back wall along its longitudinal direction, said parallel walls forming a channel between them. The inside surface of the side walls forming the channel are each configured as one-half the contour of the longitudinal cross section of the golf tee, essentially a silhouette outline along each side of the tee. A third wall is disposed across the bottom end of the back wall, closing the channel between the side walls to prevent the tees from falling out. One of the side channel forming walls includes a raised interior surface portion, convex in shape, such that the distance between the tip of the convex surface portion and the opposing side wall is slightly smaller than the diameter of a tee shaft forming a friction engaging surface to prevent removal of the tees except by manual action of the user. A fastening ring is connected to the tee holder to couple the tee holder to a golf bag or a belt loop.

The channel formed by the side walls permits the tees to be loaded at one end of the holder, with the tee head and a small portion of the shaft in the channel, and the tees disposed parallel along the channel. The end tip of the last tee in the channel is available for easy grasping and quick removal by merely sliding the tee body past the friction engagement surface disposed at the top of the channel. However the friction engagement portion is sufficient to prevent any of the other tees from falling out through the channel opening either by accelerated movement of the tee holder (bumps), or by inadvertently turning the tee holder over (gravity). While the tees are in the stored position in the channel, each tee body and tip is clearly observable.

The back wall may include an elongated segment that includes an aperture for receiving a retaining ring which snaps open and closed allowing the tee holder to be engaged to a belt loop or a suitable strap on a golf bag.

It is an object of this invention to provide an improved golf tee holder that is easily accessible for removing tees while holding a large number of tees in a very small compact receptacle.

It is another object of this invention to provide an improved golf tee holder that is rigid and durable in construction, unitarily formed, which holds a plurality of golf tees which are easily accessible to the user.

And still another object of this invention to provide an improved golf tee holder that is not bulky but conveniently sized for storage of a plurality of tees which are easily accessible from their stored position.

In accordance with these and other objects which will be apparent hereinafter, the instant invention will now be described with particular reference to the accompanying drawings.

BRIEF DESCRIPTION OF THE DRAWINGS

FIG. 1 shows a front elevational view of the present invention.

FIG. 2 shows a side elevational view of the present invention.

FIG. 3 shows a top plan view of the present invention without the holding ring.

FIG. 4 shows an end cross sectional view taken through section 4—4 of FIG. 2.

FIG. 5 shows an end cross sectional view taken through section 5—5 of FIG. 2.

FIG. 6 shows a side elevational view of the present invention including a plurality of golf tees.

PREFERRED EMBODIMENT OF THE INvENTION

Referring now to the drawings and especially FIG. 1, the present invention is shown generally at 10 comprised of a rigid elongated back wall 12, the width of the wall being just larger than the diameter of a conventional tee head, a pair of parallel side walls 14 and 16 which extend outwardly from the back wall approximately half the length of the conventional tee forming a channel and a bottom wall 18 which encloses the bottom of the channel between side walls 14 and 16.

Back wall 12 includes an aperture 12*a* which receives a conventional holding ring 20 which can be used to attach the tee holder to a belt loop or a golf bag strap.

Side wall 16 includes an interior raised surface portion 16*a*, convex in shape, near the mouth of the channel between side walls 14 and 16. The distance between the interior surface of side wall 14 and the raised apex surface portion 16*a* is slightly less than the diameter of the shaft of the tee. Also the raised portion 16*a* (see FIG. 3) extends only in the upper portion of wall 16 on the interior wall surface. The raised portion 16*a* prevents a tee from sliding inadvertently out of the tee holder because of the friction surface presented on the tee shaft between wall 14 and the raised apex surface portion 16*a*.

FIG. 2 shows side wall 16 and the interior apex surface portion 16*a* (dotted) near the mouth of the channel. The extending lip 12*b* of wall 12 provides for location of the aperture 12*a* to receive the securing ring 20.

FIG. 3 shows the overall configure of the channel formed between side walls 14 and 16 and the back wall 12 in that the lower portion of the channel near the back wall 12 is substantially in the configuration of the tee head as the inside wall surfaces of side walls 14 and 16 are inclined towards each other inwardly and sized particularly to receive the head of the tee while the upper remaining interior surface portion of the walls receive a portion of the shaft of the tee.

FIG. 4 shows the overall interior surface configurations substantially along the channel formed by side wall 14, back wall 12 and side wall 16 that extends throughout most of the channel beginning past the mouth and the raised portion 16*a*. Note that tee 22 located in this portion of the channel cannot vertically rise out of the channel because of the distance between the upper surfaces of wall 14 and wall 16 and the width of the tee head which is larger.

FIG. 5 shows the raised apex surface portion 16*a* just adjacent the mouth of the channel such that the distance between the convex surface portion 16*a* and the inside surface of wall 14 are just slightly less than the shaft diameter of a conventional tee 22. To remove the tee 22, the user grasps the upper end portion of the tee shaft, and applies a slight pressure which overcomes the friction and causes side walls 14 and 16 to expand outwardly. This allows the tee to slide out the mouth of the tee holder.

FIG. 6 shows the tee holder 10 with a plurality of tees 22 disposed therein in the normal operating mode of the invention. Note that each tee 22 and especially the shaft and end tips can quickly be visibly inspected while in fact the spacing between the tees permits inspection of the bottom portion of the tee head as well. As stated above, to remove the tee 24 nearest the mouth, the tee 24 is grasped and pressure applied to overcome the friction between raised surface portion 16*a* and inside surface of wall 14 to quickly remove the tee from the holder.

With respect to the overall construction, the device can be unitarily formed as one piece of a lightweight durable plastic or plastic-like material.

The instant invention has been shown and described herein in what it is considered to be the most practical and preferred embodiment. It is recognized, however, that departures may be made therefrom within the scope of the invention and that obvious modifications will occur to a person skilled in the art.

What I claim is:

1. A receptacle for holding a plurality of conventional golf tees in a serial line side by side, each tee having ahead and a shaft, said receptacle comprising;

(a) an elongated back wall having at least one planar surface, said planar surface having a width larger than the golf tee head diameter of one of said golf tees;

(b) a pair of parallel side walls connected to and projecting orthogonally outward from said planar surface along the longitudinal axis of said planar surface, said side walls forming a substantially golf tee shaped channel between said side walls, said channel having a first and an opposite second end, said channel sized to retain said golf tees located in said channel in an outward direction from said back wall;

(c) means, located at said channel first end, for retaining said plurality of golf tees within said channel; and, (d) means, located at said channel second end, for retaining said plurality of golf tees within said channel, said means for retaining located at said second end, including means for allowing mutual insertion and removal of golf tees located in said channel;

whereby said plurality of golf tees are manually inserted into said channel past said means for retaining at said channel second end and are securely held in said channel until said golf tees are removed form said channel at said second end.

2. The receptacle of claim 1, wherein said means for retaining at said channel first end is a bottom wall projecting orthogonally outward from said planar surface, said bottom wall joining said parallel side walls across said channel first end thereby closing said channel at said first end.

3. The receptacle of claim 2, wherein said means for retaining at said second end includes a convex raised surface portion on at least one side wall protruding into said channel across said second channel end, the distance from said raised surface to the opposite side wall being less than the thickness of said golf tee shaft.

4. The receptacle of claim 3, wherein said side walls project outward from the back wall a distance approximately less than one-half the length of said golf tees.

5. The receptacle of claim 4, wherein said back wall, said side walls and said bottom wall are unitarily formed from a lightweight durable plastic material.

6. The receptacle of claim 5, wherein said back wall further includes an aperture for receiving a means for removably attaching, said means for removably attaching extending through said aperture.

7. The receptacle of claim 6, wherein said means for removably attaching in an attachment ring, said attachment ring being attachable to a belt loop.

8. The receptacle of claim 6, wherein said means for removably attaching is an attachment ring, said attachment ring is attachable to a golf bag strap.

9. A receptacle for holding a plurality of golf tees, comprising:

(a) an elongated back wall having at least one planar surface, said planar surface having a width larger than the largest diameter of said golf tees;

(b) a pair of parallel side walls projecting outward from said planar surface along the longitudinal axis of said planar surface, said side walls having parallel first ends and parallel second ends, said side walls forming a substantially golf tee shaped channel between said side walls, said channel having a top opening, said channel sized to retain said golf tees located in said channel in a direction outward of said back wall, said side walls expandable away from each other near the channel top opening;

(c) a bottom wall joining said side walls at said first end, said bottom wall projecting outward approximately one-half the distance said side walls project outward, said bottom wall partially closing said channel;

one of said side walls including a convex raised surface portion located at said second end directed into said channel, the space between the raised portion and the opposing wall being less than the shaft diameter of a golf tee, whereby said golf tees are individually manually directed over said raised surface portion to enter and exit said channel at said second end and are securely housed in said receptacle until manually removed.

10. The receptacle of claim 9, wherein said side walls project outward a distance approximately one-half the length of said golf tees.

11. The receptacle of claim 10, wherein said back wall, said side walls and said bottom wall are unitarily formed from a lightweight durable plastic material.

12. The receptacle of claim 11, wherein said back wall further includes an aperture for receiving a means for removably attaching, said means for removably attaching extending through said aperture.

13. The receptacle of claim 12, wherein said means for removably attaching is an attachment ring, said attachment ring being attachable to a belt loop.

14. The receptacle of claim 12, wherein said means for removably attaching is an attachment ring, said attachment ring is attachable to a golf bag strap.

* * * * *